US010391787B2

(12) United States Patent
Ikehata et al.

(10) Patent No.: US 10,391,787 B2
(45) Date of Patent: Aug. 27, 2019

(54) INKJET PRINTER

(71) Applicant: Roland DG Corporation, Hamamatsu-shi, Shizuoka (JP)

(72) Inventors: Katsuo Ikehata, Hamamatsu (JP); Yoshinari Ogura, Hamamatsu (JP); Yuya Nishihara, Hamamatsu (JP); Seishin Yoshida, Hamamatsu (JP); Yasuhito Fujita, Hamamatsu (JP); Koji Takahashi, Hamamatsu (JP); Takeshi Yagi, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/976,919

(22) Filed: May 11, 2018

(65) Prior Publication Data

US 2018/0333961 A1 Nov. 22, 2018

(30) Foreign Application Priority Data

May 16, 2017 (JP) ..... 2017-097275

(51) Int. Cl.
*B41J 2/21* (2006.01)

(52) U.S. Cl.
CPC ..... *B41J 2/2146* (2013.01); *B41J 2/2114* (2013.01); *B41J 2/2117* (2013.01)

(58) Field of Classification Search
CPC ..... B41J 2/2146; B41J 2/2144; B41J 2/2117
See application file for complete search history.

(56) References Cited

U.S. PATENT DOCUMENTS

| | | | | |
|---|---|---|---|---|
| 6,474,778 | B1 * | 11/2002 | Koitabashi | B41J 2/2107 347/100 |
| 6,578,943 | B2 * | 6/2003 | Arquilevich | B41J 2/17509 347/15 |
| 9,878,560 | B2 * | 1/2018 | Makuta | B41J 11/002 |
| 2006/0227194 | A1 | 10/2006 | Hoshino | |
| 2009/0220695 | A1 | 9/2009 | Oyanagi et al. | |
| 2012/0200633 | A1 | 8/2012 | Aoyama | |

FOREIGN PATENT DOCUMENTS

| | | | |
|---|---|---|---|
| JP | 2002-036517 | A | 2/2002 |
| JP | 2006-289722 | A | 10/2006 |
| JP | 2009-113284 | A | 5/2009 |
| JP | 2009-269397 | A | 11/2009 |
| JP | 2010-240934 | A | 10/2010 |
| JP | 2012-162002 | A | 8/2012 |
| JP | 2013-067031 | A | 4/2013 |
| JP | 2013-252640 | A | 12/2013 |
| JP | 2013-256045 | A | 12/2013 |

* cited by examiner

*Primary Examiner* — Lamson D Nguyen
(74) *Attorney, Agent, or Firm* — Keating & Bennett, LLP

(57) ABSTRACT

An inkjet printer ejects a first ink of a plurality of colors and a second ink. An extractor extracts an underlying layer dot group from ink dots of the first ink of each of the plurality of colors. Such underlying layer dot groups and ink dots of the second ink form a first printing layer. An image dot group including at least the ink dots, of the first ink, other than the underlying dot groups forms at least one additional printing layer. The underlying dot groups are each extracted from the ink dots of the first ink of the corresponding color based on a predetermined extraction ratio.

12 Claims, 5 Drawing Sheets

104a

| | Rp1 1ST EXTRACTION RATIO | | Rp2 2ND EXTRACTION RATIO | | Rp3 3RD EXTRACTION RATIO | | Rp4 4TH EXTRACTION RATIO | |
|---|---|---|---|---|---|---|---|---|
| A | 5 | % | 34 | % | 27 | % | 28 | % |
| B | 25 | % | 25 | % | 25 | % | 25 | % |
| | | | | | | | | |

INKJET PRINTER

CROSS REFERENCE TO RELATED APPLICATIONS

This application claims the benefit of priority to Japanese Patent Application No. 2017-097275 filed on May 16, 2017. The entire contents of this application are hereby incorporated herein by reference.

BACKGROUND OF THE INVENTION

1. Field of the Invention

The present invention relates to an inkjet printer.

2. Description of the Related Art

Conventionally, an inkjet printer for large format printing that includes a plurality of recording heads arrayed in a direction perpendicular to a scanning direction of a head unit is known. The inkjet printer having such a structure performs printing on a large area of a recording medium within a short time. Japanese Laid-Open Patent Publication No. 2013-67031 discloses an inkjet recording device including a plurality of head units arrayed in the scanning direction. The plurality of head units each include a plurality of recording heads arrayed in a feeding direction perpendicular to the scanning direction.

Some of recording mediums, such as cloth, paper and the like are not white. In the case in which process color ink is directly ejected onto such a non-white recording medium, the real color of the ink may not be provided. According to a technique for dealing with this situation, a recording head ejecting white ink is added to the printer described in Japanese Laid-Open Patent Publication No. 2013-67031. With this technique, first, a white ink layer is formed on the recording medium. After the white ink layer is formed on the recording medium, an image layer of process color ink is formed on the white ink layer. In this manner, a color close to the real color of the ink is able to be printed even on a recording medium that is not white.

Usually, the above-described technique provides a sufficiently high level of image quality even on a recording medium that is not white. However, a still higher level of image quality may be desired for some uses of the printed item. In the field of, for example, outdoor advertisements or the like, there is a need for an image providing a strong impression of having depth or massiveness in order to attract more attention. However, often, the conventional printing method does not fulfill such a need. A reason for this is that the image layer is thin and, thus, the influence of special color ink forming the underlying color layer is not completely eliminated. For example, in the case in which the special color ink is white ink, the image appears whitish and, thus, lacks massiveness. In order to deal with such a situation, the inventors of preferred embodiments of the present invention developed a method of printing an underlying color layer with a portion of an image being mixed in the underlying color layer. More specifically, according to this method, a portion of ink dots of process color ink used to form the image is extracted at a predetermined extraction ratio and printed concurrently with the underlying color layer, and then the image is printed to overlap the underlying color layer. The inventors of preferred embodiments of the present invention have discovered that the above-described method is able to provide a printed item appearing to be more massive than by conventional overlapping printing.

However, a printed item provided by the above-described method may involve the following problem. When the image is printed as being mixed in the underlying color layer (hereinafter, the image printed as being mixed in the underlying color layer will be referred to as an "underlying image"), a color of ink that is not conspicuous against the color of the underlying color layer is developed more weakly than the other colors of ink. As a result, the image in a finished state has a color balance different from that of the image according to the printing data (hereinafter, the image according to the printing data will be referred to as an "original image").

SUMMARY OF THE INVENTION

Preferred embodiments of the present invention provide inkjet printers each providing a high quality image by overlapping printing.

An inkjet printer according to a preferred embodiment of the present invention includes a recording head including a first color ink head to form ink dots of a first ink of a first color on a recording medium, a second color ink head to form ink dots of a first ink of a second color on the recording medium, and a second ink ink head to form ink dots of a second ink on the recording medium; and a transporter to move the recording head and the recording medium with respect to each other; and a controller connected with the recording head and the transporter to control the recording head and the transporter. The first color ink head includes a plurality of nozzles through which the first ink of the first color is ejected towards the recording medium. The second color ink head includes a plurality of nozzles through which the first ink of the second color is ejected towards the recording medium. The second ink ink head (i.e., an ink head for the second ink) includes a plurality of nozzles through which the second ink is ejected towards the recording medium. The controller is configured or programmed to include a first extractor to extract a first underlying layer dot group from the ink dots of the first ink of the first color; a second extractor to extract a second underlying layer dot group from the ink dots of the first ink of the second color; a first printing controller configured or programmed to form a first printing layer on the recording medium; and at least one additional printing controller configured or programmed to form one additional printing layer, above or below the first printing layer. The first extractor extracts the first underlying layer dot group from the ink dots of the first ink of the first color such that a ratio of the first underlying layer dot group with respect to the ink dots of the first ink of the first color is a first extraction ratio. The second extractor extracts the second underlying layer dot group from the ink dots of the first ink of the second color such that a ratio of the second underlying layer dot group with respect to the ink dots of the first ink of the second color is a second extraction ratio. The first printing controller forms the first printing layer to include at least the first underlying layer dot group, the second underlying layer dot group and the ink dots of the second ink. The at least one additional printing controller forms one additional printing layer of an image dot group including at least the ink dots, of the first ink of the first color, other than the first underlying layer dot group and the ink dots, of the first ink of the second color, other than the second underlying layer dot group.

According to preferred embodiments of the present invention, the second ink and a portion of the first ink (underlying layer dot groups) are printed concurrently to form the "first printing layer". Another portion of the first ink (image dot group) is printed to form the "additional printing layer(s)" above or below the "first printing layer". In this manner, the image of the "first printing layer" (underlying image) and the image of the "additional printing layer(s)" (hereinafter, this image will be referred to as the "subject image") are printed in an overlapping manner, such that an image appearing to be more massive than by conventional overlapping printing is able to be provided. In addition, to extract the underlying layer dot group from the ink dots of the first ink, the extraction ratio is able to be set independently for each color of the first ink. In the case in which the ink dots of all the colors of the first ink are extracted at the same extraction ratio as the underlying layer dot groups, the finished image may have a different color balance from that of the original color as described above. Inkjet printers according to preferred embodiments of the present invention adjust the extraction ratio independently for each color, so that the finished image has a desired color balance.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
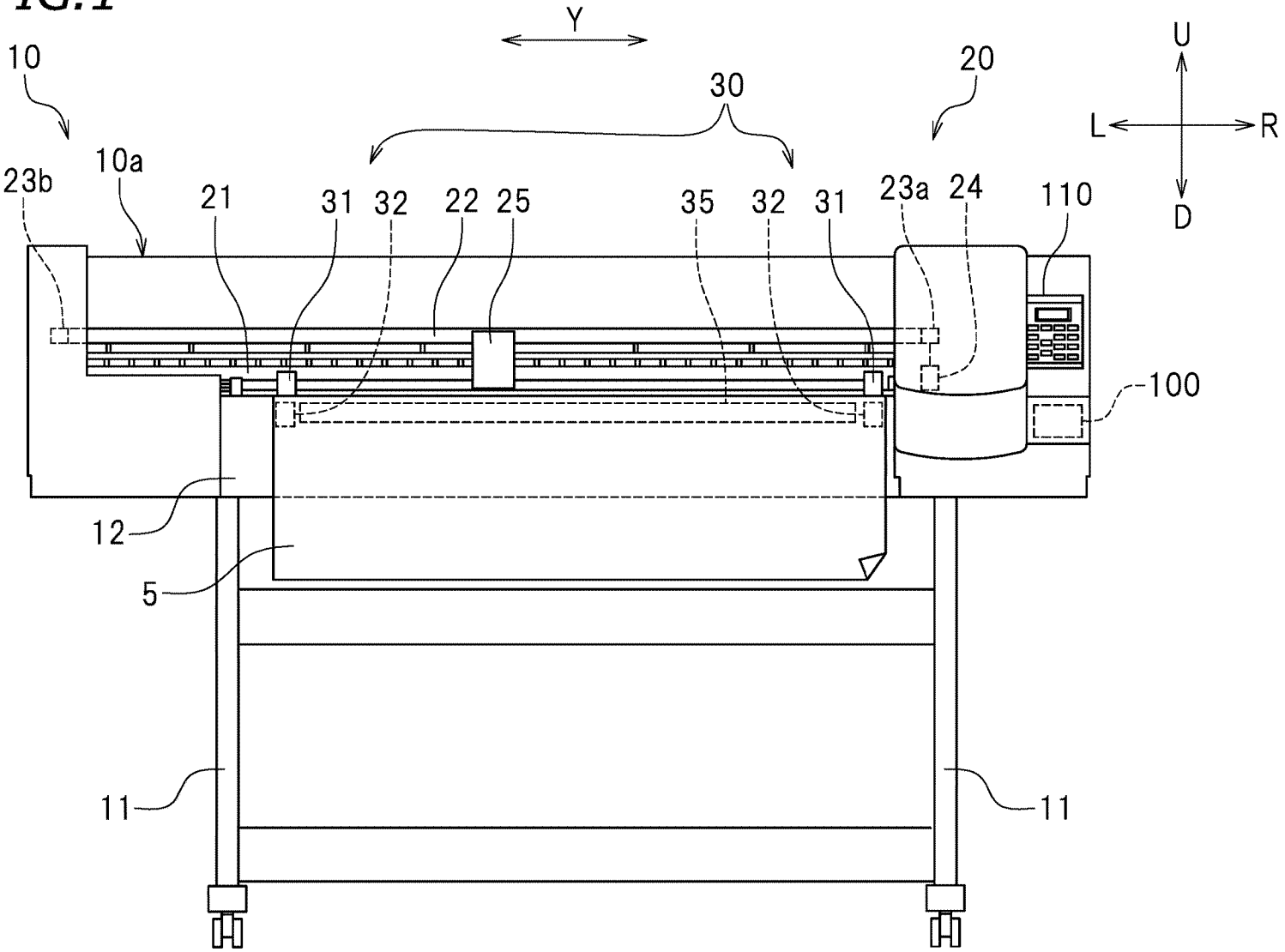
FIG. 1 is a front view of an inkjet printer according to a preferred embodiment of the present invention.

Hereinafter, preferred embodiments of inkjet printers according to the present invention will be described with reference to the drawings. The preferred embodiments described below are not intended to specifically limit the present invention. Components and portions that have the same or similar functions will be denoted by the same reference signs, and overlapping descriptions will be omitted or simplified. In the following description, a direction from an inkjet printer towards a user facing a front surface of the inkjet printer is referred to as "forward", and a direction distanced from the user is referred to as "rearward". In the drawings, letter Y refers to a scanning direction, and letter X refers to a feeding direction perpendicular or substantially perpendicular to the scanning direction. In the drawings, letters F, Rr, L, R, U and D respectively refer to "front", "rear", "left", "right", and "down". These directions are also based on the user facing the front surface of the inkjet printer. It should be noted that these directions are provided merely for the sake of convenience, and do not limit the manner of installation or configuration of the inkjet printer in any way. The expression that one component is "above" (or "below") another component may refers to a state in which the one component is above (or below) the another component while being in direct contact with the another component, as well as a state in which the one component is above (or below) the another component with still another component provided between the one component and the another component.

FIG. 1 is a front view of a large-scale inkjet printer (hereinafter, referred to a "printer") 10 according to a preferred embodiment of the present invention. The printer 10 sequentially moves a roll recording medium 5 forward (towards a downstream side X2 in the feeding direction X; see FIG. 2), while ejecting ink from ink heads 40, 50, 60, 70 and 80 (see FIG. 2) mounted on a carriage 25 moving in the scanning direction Y, to print an image on the recording medium 5.

The recording medium 5 is a target on which an image is to be printed. There is no specific limitation on the type of the recording medium 5. The recording medium 5 may be, for example, paper, such as plain paper, printing paper for an inkjet printer, or other suitable paper. The recording medium 5 may be, for example, a transparent sheet made of a resin, glass or other suitable material. The recording medium 5 may be, for example, a sheet made of a metal material, rubber or other suitable material. In the present preferred embodiment, the recording medium 5 is preferably a transparent sheet.

As shown in FIG. 1, the printer 10 includes a printer main body 10*a* and legs 11 supporting the printer main body 10*a*. The printer main body 10*a* extends in the scanning direction Y. The printer main body 10*a* includes a guide rail 21 and the carriage 25 engaged with the guide rail 21. The guide rail 21 extends in the scanning direction Y. The guide rail 21 guides the carriage 25 such that the carriage 25 moves in the scanning direction Y. An endless belt 22 is secured to the carriage 25. The belt 22 is wrapped along, and extends between, a pulley 23*a* provided at a right end of the guide rail 21 and a pulley 23*b* provided at a left end of the guide rail 21. A carriage motor 24 is attached to the right pulley 23*a*. The carriage motor 24 is electrically connected with a controller 100. The carriage motor 24 is controlled by the controller 100. When the carriage motor 24 is driven, the pulley 23*a* is rotated to drive the belt 22. As a result, the carriage 25 moves in the scanning direction Y along the guide rail 21. Along with the movement of the carriage 25 in the scanning direction Y, the ink heads 40 through 80 also move in the scanning direction Y. In the present preferred embodiment, the belt 22, the pulley 23*a*, the pulley 23*b*, and the carriage motor 24 are included in the carriage mover 20 that moves the carriage 25 and the ink heads 40 through 80, mounted on the carriage 25, in the scanning direction Y.

A platen 12 is located below the carriage 25. The platen 12 extends in the scanning direction Y. The recording medium 5 is to be placed on the platen 12. Pinch rollers 31 pressing the recording medium 5 from above are provided above the platen 12. The pinch rollers 31 are located to the rear of the carriage 25. The platen 12 is provided with grit rollers 32. The grit rollers 32 are located below the pinch rollers 31. The grit rollers 32 are located at a position facing the pinch rollers 31. The grit rollers 32 are coupled with a feed motor 33 (see FIG. 3). The grit rollers 32 are rotatable upon receipt of a driving force of the feed motor 33. The feed motor 33 is electrically connected with the controller 100. The feed motor 33 is controlled by the controller 100. When the grit rollers 32 are rotated in the state in which the recording medium 5 is disposed between the pinch rollers 31 and the grit rollers 32, the recording medium 5 is fed in the feeding direction X. In the present preferred embodiment, the pinch rollers 31, the grit rollers 32, and the feed motor 33 are included in the feeder 30 moving the recording medium 5 in the feeding direction X. The feeder 30 and the carriage mover 20 are included in a transporter that moves the recording medium 5 and the carriage 25 with respect to each other.

Figure 2:
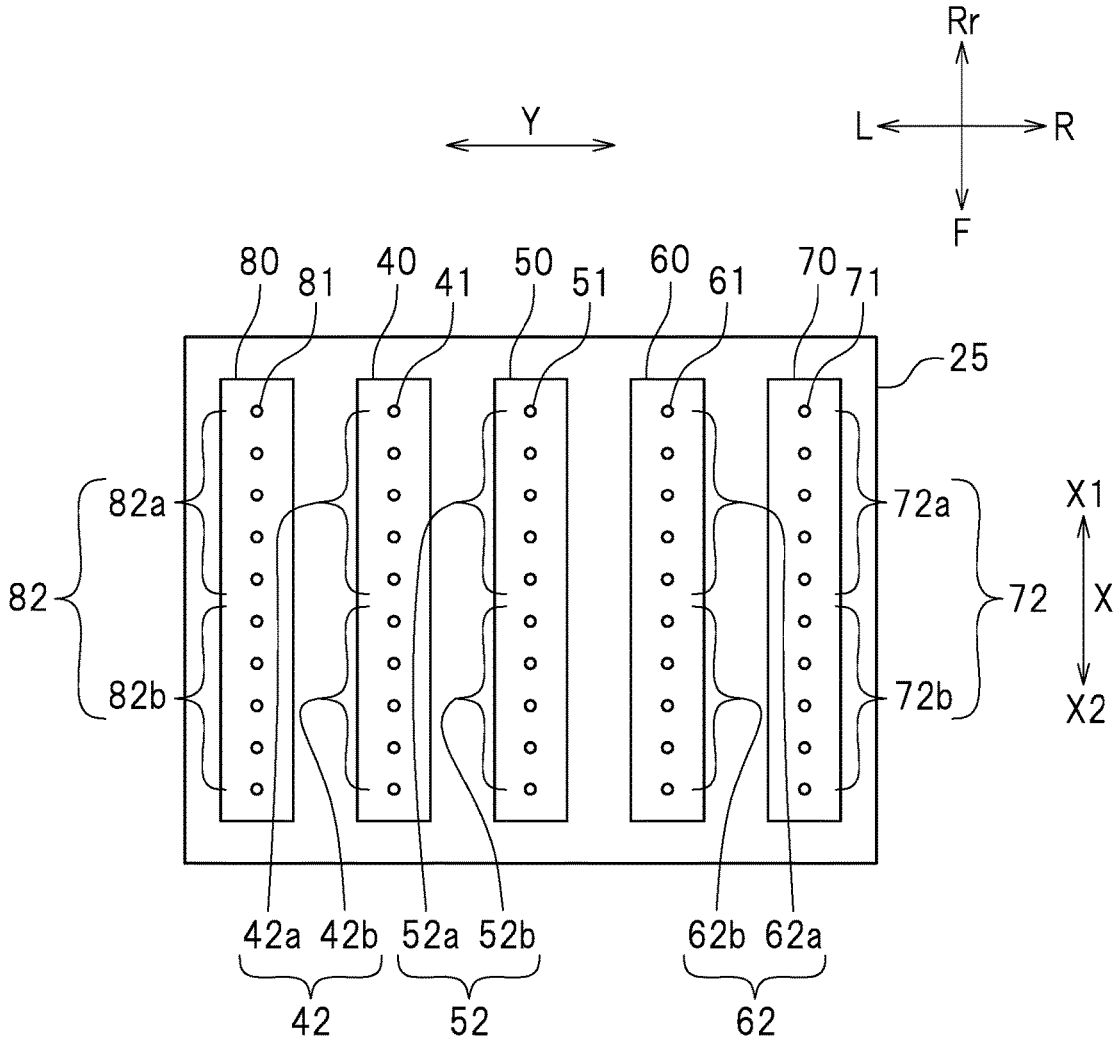
FIG. 2 is a schematic view showing a structure of a bottom surface of a carriage.

FIG. 2 is a schematic view showing a structure of a surface of the carriage 25 that faces the recording medium 5 (in the present preferred embodiment, a bottom surface of the carriage 25). As shown in FIG. 2, the carriage 25 includes, at the bottom surface, the ink heads 40 through 80, more specifically, a first process color ink head 40, a second process color ink head 50, a third process color ink head 60, a fourth process color ink head 70, and a special color ink head 80. As shown in FIG. 2, the first process color ink head 40 through the fourth process color ink head 70 and the special color ink head 80 are located side by side in the scanning direction Y on the carriage 25. The first process color ink head 40, the second process color ink head 50, the third process color ink head 60, the fourth process color ink head 70, and the special color ink head 80 are included in a recording head. Herein, the "first process color ink head" refers to the ink head for the first process color, and this is applicable to the other ink heads.

In the present preferred embodiment, the special color ink head 80 ejects special color ink that changes the color tone or the design of a color image. The special color ink is an example of "second ink". In the present preferred, the special color ink head 80 preferably ejects white ink, for example. The color tone of the special color ink is not limited to white. The "special color ink" includes ink other than the process color ink, such as C ink, M ink, Y ink, K ink or other process color inks, for example, metallic ink, such as silver ink, gold ink or other metallic ink, and transparent ink. In the present preferred embodiment, one special color ink head is preferably provided. The number of the special color ink head(s) is not limited to one. For example, two or more special color ink heads may be provided. There is no limitation on the color tone of the special color ink. The special color ink head 80 may eject, for example, metallic ink, such as silver ink, gold ink or other metallic ink, or transparent ink, for example.

As shown in FIG. 2, the special color ink head 80 includes a plurality of nozzles 81 arrayed in the feeding direction X. In the special color ink head 80 in the present preferred embodiment, the plurality of nozzles 81 are arrayed in one line to define a nozzle array 82. There is no limitation on the positional arrangement of the nozzles 81. The nozzles array 82 includes a special color upstream nozzle array 82*a* located on an upstream side X1 in the feeding direction X, and a special color downstream nozzle array 82*b* located on the downstream side X2 in the feeding direction X. In the present preferred embodiment, the number of the nozzles 81 in the special color upstream nozzle array 82*a* and the number of the nozzles 81 in the special color downstream nozzle array 82*b* are preferably equal to each other. The number of the nozzles 81 in the special color upstream nozzle array 82*a* and the number of the nozzles 81 in the special color downstream nozzle array 82*b* do not need to be equal to each other. Herein, the "special color upstream nozzle array" refers to the upstream nozzle array for the special color, and this is applicable to the special color downstream nozzle array, and also to first through fourth process color upstream nozzle arrays and first through fourth process color downstream nozzle arrays described below.

The first process color ink head 40 through the fourth process color ink head 70 each eject process color ink usable to form a color image. The process color ink is an example of "first ink". In the present preferred embodiment, the first process color ink head 40 preferably ejects black ink, for example. The second process color ink head 50 preferably ejects yellow ink, for example. The third process color ink head 60 preferably ejects magenta ink, for example. The fourth process color ink head 70 preferably ejects cyan ink, for example. The number of the process color ink heads is not limited to four. There is no limitation on the color tone of the process color ink.

As shown in FIG. 2, the first process color ink head 40 includes a plurality of nozzles 41 arrayed in the feeding direction X. In the first process color ink head 40 in the present preferred embodiment, the plurality of nozzles 41 are arrayed in one line to define a nozzle array 42. There is no limitation on the positional arrangement of the nozzles 41. The nozzles array 42 includes a first process color upstream nozzle array 42*a* located on the upstream side X1 in the feeding direction X, and a first process color downstream nozzle array 42*b* located on the downstream side X2 in the feeding direction X. In the present preferred embodiment, the number of the nozzles 41 in the first process color upstream nozzle array 42*a* and the number of the nozzles 41 in the first process color downstream nozzle array 42*b* are preferably equal to each other. The number of the nozzles 41 in the first process color upstream nozzle array 42*a* and the number of the nozzles 41 in the first process color downstream nozzle array 42*b* do not need to be equal to each other.

The second process color ink head 50 through the fourth process color ink head 70 each preferably have the same or substantially the same structure as that of the first process color ink head 40. Specifically, the second process color ink head 50 includes a plurality of nozzles 51 arrayed in the feeding direction X, and the nozzles 51 define a nozzle array 52. The nozzle array includes a second process color upstream nozzle array 52*a* located on the upstream side X1 in the feeding direction X, and a second process color downstream nozzle array 52*b* located on the downstream side X2 in the feeding direction X. The third process color ink head 60 includes a plurality of nozzles 61 arrayed in the feeding direction X, and the nozzles 61 define a nozzle array 62. The nozzle array 62 includes a third process color upstream nozzle array 62*a* located on the upstream side X1 in the feeding direction X, and a third process color downstream nozzle array 62*b* located on the downstream side X2 in the feeding direction X. The fourth process color ink head 70 includes a plurality of nozzles 71 arrayed in the feeding direction X, and the nozzles 71 define a nozzle array 72. The nozzle array 72 includes a fourth process color upstream nozzle array 72*a* located on the upstream side X1 in the feeding direction X, and a fourth process color downstream nozzle array 72*b* located on the downstream side X2 in the feeding direction X. The nozzles in the first process color ink head 40 through the fourth process color ink head 70 and the nozzles in the special color ink head 80 are located at positions that are matched, in the feeding direction X, to each other. In each of the first process color ink head 40 through the fourth process color ink head 70, the number of the nozzles in the upstream nozzle array and the number of the nozzles in the downstream nozzle array are preferably equal to each other.

In FIG. 2, the first process color ink head 40 through the fourth process color ink head 70 and the special color ink head 80 are each shown as including 10 nozzles. In actuality, the first process color ink head 40 through the fourth process color ink head 70 and the special color ink head 80 each include a larger number of (e.g., about 300) nozzles. There is no limitation on the number of the nozzles.

The first process color ink head 40 through the fourth process color ink head 70 and the special color ink head 80 each include actuators (not shown), each preferably including a piezoelectric element and other elements, provided therein. The actuators are electrically connected with the controller 100. The actuators are controlled by the controller 100. The actuators are driven, and as a result, the ink is ejected towards the recording medium 5 from the nozzles of the ink heads 40 through 80.

The first process color ink head 40 through the fourth process color ink head 70 and the special color ink head 80 are each in communication with an ink cartridge (not shown) via an ink supply path (not shown). The ink cartridge is detachably located at, for example, a right end of the printer main body 10*a*. There is no limitation on the material of the ink, and any of various materials conventionally used as an ink material for an inkjet printer may be usable. The ink may be, for example, solvent-based pigment ink or aqueous pigment ink. Alternatively, the ink may be, for example, aqueous dye ink, ultraviolet-curable pigment ink cured upon receipt of ultraviolet rays, or other suitable inks.

As shown in FIG. 1, the printer 10 includes a heater 35. The heater 35 is provided below the platen 12. The heater 35 is located to the front of the grit rollers 32. The heater 35 heats the platen 12. The platen 12 is heated so that the recording medium 5 placed on the platen 12 and the ink disposed on the recording medium 5 are heated. Thus, the drying of the ink is promoted. The heater 35 is electrically connected with the controller 100. The temperature to which the heater 35 is heated is controlled by the controller 100.

Figure 3:
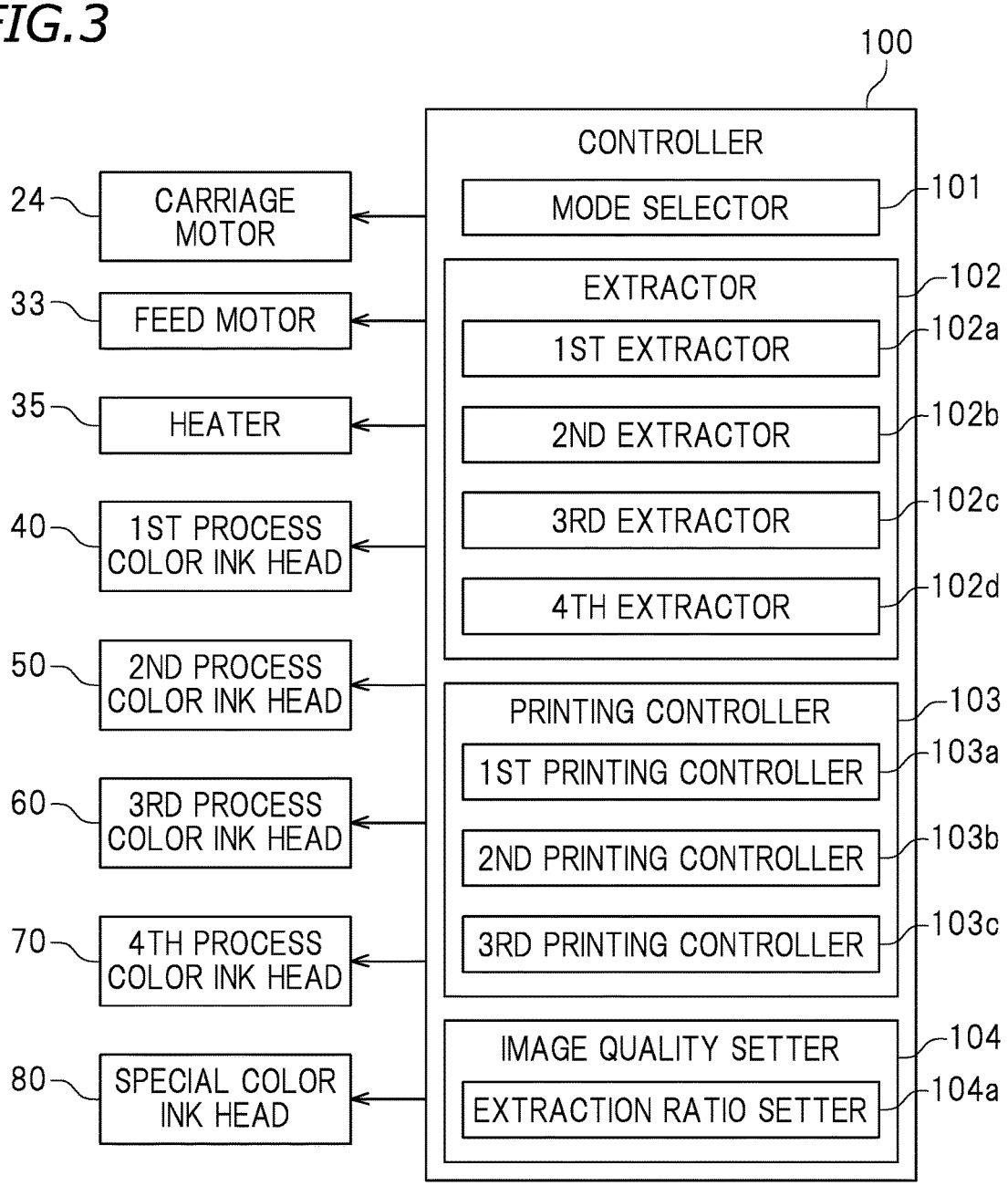
FIG. 3 is a block diagram of the printer.

As shown in FIG. 1, an operation panel 110 is provided at the right end of the printer main body 10*a*. The operation panel 110 includes a display that displays a state of the printer 10, input keys operable by the user, and other controls. The controller 100 that controls various operations of the printer 10 is accommodated in the operation panel 110. FIG. 3 is a block diagram of the printer 10 according to the present preferred embodiment. As shown in FIG. 3, the controller 100 is communicably connected with, and is configured or programmed to control, the feed motor 33, the carriage motor 24, the heater 35, the first process color ink head 40, the second process color ink head 50, the third process color ink head 60, the fourth process color ink head 70, and the special color ink head 80. The controller 100 includes a mode selector 101, an extractor 102, a printing controller 103, and an image quality setter 104.

There is no specific limitation on the structure of the controller 100. The controller 100 is preferably, for example, a microcomputer. There is no specific limitation on the hardware structure of the microcomputer. The microcomputer includes, for example, an interface (I/F) receiving printing data or other data from an external device, such as a host computer or other suitable device, a central processing unit (CPU) executing a command of a control program(s), a ROM (read only memory) including, stored thereon, the program(s) being executable by the CPU, a RAM (random access memory) usable as a working area in which the program is developed, and a storage device, such as a memory or other suitable storage device storing the above-described program and various types of data. The controller 100 does not need to be provided inside the printer main body 10*a*. The controller 100 may be, for example, a computer that is located outside of the printer main body 10*a* and is communicably connected with the printer main body 10*a* in a wired or wireless manner.

The mode selector 101 is usable to select a printing mode. In the present preferred embodiment, the printing mode is classified into "normal printing" and "overlapping printing". The "overlapping printing" is classified into "first overlapping printing" and "second overlapping printing". According to the "first overlapping printing", an underlying color of the special color ink and an underlying image of the process color ink are printed to form a lower layer, and a subject image of the process color ink is printed to form an upper layer. According to the "second overlapping printing", the subject image of the process color ink is printed to form a lower layer, and the underlying color and the underlying image are printed to form an upper layer. In the "overlapping printing" according to the present preferred embodiment, two layers are preferably printed in an overlapping manner. The "first overlapping printing" and the "second overlapping printing" will be described in detail below. The printing mode may be provided in advance in the printing data and automatically selected. Alternatively, the printing mode may be selected appropriately by an operator.

The extractor 102 extracts a plurality of "underlying layer dot groups" from ink dots of the plurality of colors of process color ink. The "underlying layer dot groups" include ink dots usable to form an underlying image, and each include a portion of the ink dots of the corresponding color of process color ink. The extractor 102 includes a first extractor 102*a*, a second extractor 102*b*, a third extractor 102*c*, and a fourth extractor 102*d*. The first extractor 102*a* provides a "first underlying layer dot group" of the ink dots of the process color ink ejected from the first process color ink head 40 (in the present preferred embodiment, preferably black ink). The second extractor 102*b* provides a "second underlying layer dot group" of the ink dots of the process color ink ejected from the second process color ink head 50 (in the present preferred embodiment, preferably yellow ink). The third extractor 102*c* provides a "third underlying layer dot group" of the ink dots of the process color ink ejected from the third process color ink head 60 (in the present preferred embodiment, preferably magenta ink). The fourth extractor 102*d* provides a "fourth underlying layer dot group" of the ink dots of the process color ink ejected from the fourth process color ink head 70 (in the present preferred embodiment, preferably cyan ink). A method for extracting the ink dots to provide each of the "underlying layer dot groups" will be described below. Herein, the "first underlying layer dot group" refers to the first dot group for the underlying layer, and this is applicable to the other underlying layer dot groups.

The printing controller 103 controls the printing operation. The printing controller 103 controls the carriage motor 24, the feed motor 33, and the ink heads 40 through 80 to perform printing. The printing controller 103 controls the temperature of the heater 35 to promote drying of the ink after the ejection. The printing controller 103 is preferably configured or programmed to include a first controller 103*a*, a second controller 103*b*, and a third controller 103*c*.

In the printing controller 103, the first printing controller 103*a* controls a concurrent printing operation of the underlying color and the underlying image. Hereinafter, a printing layer formed by the above-described concurrent printing operation may be referred to as a "first printing layer". The "first printing layer" includes the ink dots of the special color ink and the ink dots extracted to provide the "underlying layer dot groups" among the ink dots of the plurality of colors of process color ink. The first printing controller 103*a* controls the carriage motor 24, the feed motor 33, and the ink heads 40 through 80 to perform the concurrent printing operation of the special color ink and the "underlying layer dot groups". The first printing controller 103*a* controls the carriage motor 24, the feed motor 33, and the ink heads 40 through 80 in a different manner in accordance with which of the "first overlapping printing" and the "second overlapping printing" is selected by the mode selector 101. More specifically, when the "first overlapping printing" is selected by the mode selector 101, the first printing controller 103*a* controls the components such that the "first printing layer" is formed as the lower layer. By contrast, when the "second overlapping printing" is selected by the mode selector 101, the first printing controller 103*a* controls the components such that the "first printing layer" is formed as the upper layer. The details of the control will be described below.

In the printing controller 103, the second printing controller 103*b* controls a printing work of the subject image. Hereinafter, a printing layer provided by such printing may be referred to as a "second printing layer". In the present preferred embodiment, the "second printing layer" preferably includes the entirety of the ink dots of the plurality of colors of process color ink. More specifically, in the present preferred embodiment, where the entirety of the ink dots of the plurality of colors of process color ink is 100%, the "second printing layer" preferably includes 100% of the ink dots. In other words, the subject image in the present preferred embodiment is preferably the same or substantially the same as the original image according to the printing data. Hereinafter, the ink dots of the subject image will be collectively referred to as an "image dot group". The "image dot group" of the plurality of colors of process color ink is printed by the second printing controller 103*b* to form the "second printing layer" above or below the "first printing layer". When the "first overlapping printing" is selected by the mode selector 101, the "second printing layer" is formed above the "first printing layer". By contrast, when the "second overlapping printing" is selected by the mode selector 101, the "second printing layer" is formed below the "first printing layer" before the "first printing layer" is formed. The second printing controller 103*b* controls the carriage motor 24, the feed motor 33, and the process color ink heads 40 through 70 to print the subject image of the "image dot group" of the plurality of colors of process color ink. The details of the control will be described below.

When the "normal printing" is selected by the mode selector 101, the third printing controller 103*c* controls the carriage motor 24, the feed motor 33, and the process color ink heads 40 through 70 to perform the "normal printing" on the recording medium 5. A process of the "normal printing" will be described below.

The image quality setter 104 is used to set image quality parameters for the overlapping printing. The image quality setter 104 includes an extraction ratio setter 104*a*. The extraction ratio setter 104*a* is used to set the ratio of each of the "underlying layer dot groups" with respect to the entirety of the ink dots of the corresponding color of process color ink. Namely, the extraction ratio setter 104*a* is used to set the ratio of the "first underlying layer dot group" with respect to the entirety of the ink dots of the ink ejected from the first process color ink head (in the present preferred embodiment, preferably black ink). Hereinafter, this ratio will be referred to as a "first extraction ratio". The extraction ratio setter 104*a* is used to set the ratio of the "second underlying layer dot group" with respect to the entirety of the ink dots of the ink ejected from the second process color ink head 50 (in the present preferred embodiment, preferably yellow ink). Hereinafter, this ratio will be referred to as a "second extraction ratio". The extraction ratio setter 104*a* is used to set the ratio of the "third underlying layer dot group" with respect to the entirety of the ink dots of the ink ejected from the third process color ink head 60 (in the present preferred embodiment, preferably magenta ink). Hereinafter, this ratio will be referred to as a "third extraction ratio". The extraction ratio setter 104*a* is used to set the ratio of the "fourth underlying layer dot group" with respect to the entirety of the ink dots of the ink ejected from the fourth process color ink head 70 (in the present preferred embodiment, cyan ink). Hereinafter, this ratio will be referred to as a "fourth extraction ratio". The settings of the extraction ratios will be described in detail below. The image quality setter 104 may be used to set other parameters regarding the image quality, but such settings will not be described in the explanation of the present preferred embodiment.

According to the "normal printing", one layer is printed on the recording medium 5. For the "normal printing", only the process color ink is used. In the "normal printing", the original image according to the printing data is printed. The "normal printing" is performed as follows. The third printing controller 103*c* drives the carriage motor 24 to move the carriage 25 in the scanning direction Y. The third printing controller 103*c* drives the actuators to cause the process color ink heads 40 through 70 to eject the ink, such that the process color ink is disposed on a printing surface of the recording medium 5. In addition, the third printing controller 103*c* controls the feed motor 33 such that the recording medium 5 is sequentially fed forward (F) (towards the downstream side X2 in the feeding direction X). The ink on the recording medium 5 fed by the feed motor 33 is sequentially heated by the heater 35 and thus is dried. The third printing controller 103*c*, for example, moves the carriage 25 in the scanning direction Y once or a plurality of times by the time the recording medium 5 is fed forward (F) once.

Figures 4, 5:
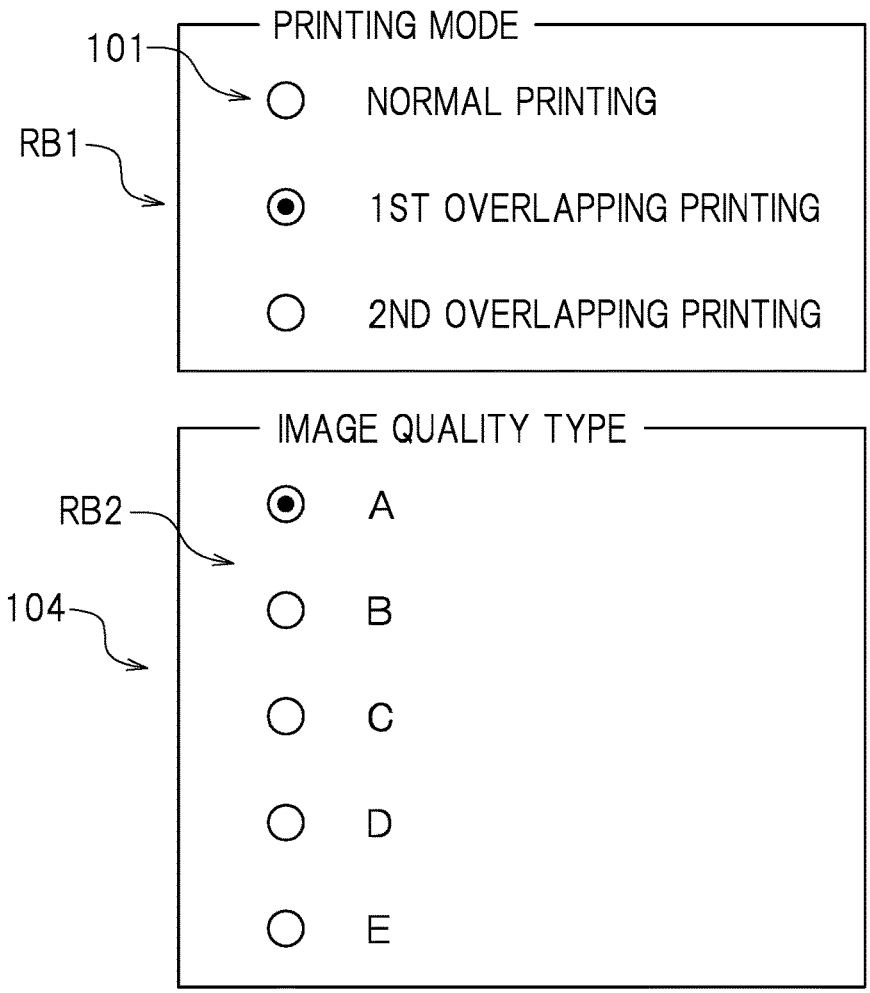
FIG. 4 shows an example of a setting screen by which a printing mode and an image quality may be set.
FIG. 5 shows an example of an internal parameter setting screen of an extraction ratio setter.

In the overlapping printing modes including the "first overlapping printing" mode and the "second overlapping printing" mode, the "first printing layer" and the "second printing layer" are formed on the recording medium 5 in an overlapping manner. Before performing the "first overlapping printing" and the "second overlapping printing", the printing mode and the image quality are set. FIG. 4 shows an example of a setting screen by which the printing mode and the image quality may be set. The setting screen shown in FIG. 4 is displayed on the operation panel 110, a display device of a computer or other suitable display by the mode selector 101 and the image quality setter 104. As shown in the setting screen in FIG. 4, the mode selector 101 includes a first radio button set RB1. The first radio button set RB1 is used to set the printing mode. As shown in FIG. 4, the first radio button set RB1 is preferably configured such that one printing mode is selected from the three printing modes of the "normal printing", the "first overlapping printing" and the "second overlapping printing", for example. In the example shown in FIG. 4, the "first overlapping printing" is selected.

As shown in the setting screen in FIG. 4, the image setter 104 includes a second radio button set RB2. As shown in FIG. 4, the second radio button set RB2 is preferably configured such that one of five image quality types A, B, C, D and E, for example, is selected. In the present preferred embodiment, parameters are preferably set in advance for each of the image quality types A, B, C, D and E inside the image setter 104. The user may select a desired image quality type. The image quality type A through E are assigned names representing features the image quality types such as, for example, "clear", "soft" and other suitable names. The second radio button set RB2 is used to select one of the five image quality types. In the example shown in FIG. 4, the "image quality type A" is selected.

FIG. 5 shows an example of an internal parameter setting screen of the extraction ratio setter 104. In the present preferred embodiment, the internal parameter setting screen is preferably created in an area usually not operable by the user. This does not exclude a preferred embodiment in which the internal parameter setting screen is operable by the user. As shown in FIG. 5, in the internal parameter setting screen, a first extraction ratio Rp1 through a fourth extraction ratio Rp4 are set for each image quality type. For example, for the image quality type A, preferably the first extraction ratio Rp1 is set to about 5%, the second extraction ratio Rp2 is set to about 34%, the third extraction ratio Rp3 is set to about 27%, and the fourth extraction ratio Rp4 is set to about 28%. The first extraction ratio Rp1 through the fourth extraction ratio Rp4 are also set for the image quality type B and the other image quality types. As described above, in the present preferred embodiment, the ink dots forming the subject image (i.e., the "image dot group") correspond to 100% of the ink dots of the process color ink.

For each image quality type, the "underlying layer dot group" is extracted from the entirety of the ink dots of each color of process color ink. For example, where the yellow ink has about 10000 ink dots in the entirety of the original image, the number of the ink dots of the yellow ink belonging to the "underlying layer dot group" (more specifically, the "second underlying layer dot group") is about 3400, which is about 34% of the about 10000 ink dots.

The "underlying layer dot group" of each color of process color ink is provided by subjecting the ink dots of the corresponding process color ink to a predetermined mask. The mask is preferably, for example, a dithering mask. The dithering mask is used to extract a portion of the ink dots by a dithering method. The dithering method is one example of a pseudo gradation expressing algorithm. According to the dithering method, when an ink value of image data in a microscopic region of a printing region higher than, or equal to, a defined threshold value, the ink dot in this microscopic region is turned ON. By contrast, when the ink value of the image data in this region is lower than the defined threshold value, the ink dot in this region is turned OFF. For example, according to the simplest dithering method, which is the binary dithering method, the image data is divided into an ON region and an OFF region by one threshold value. In this case, an image provided as a result of the binary dithering performed using the dithering mask is a rough image having a smaller number of pixels while maintaining features of the original image to a certain degree. The dithering method is not limited to the binary dithering method. The dithering method includes an ordered dithering method using matrix assigned threshold values, a random dithering method of setting threshold values randomly within a certain range, and other suitable dithering methods.

In the case of the image quality type A shown in FIG. 5, the extraction ratio for the "underlying layer dot group" is different among different colors of process color ink. Specifically, the extraction ratio for the yellow ink is preferably set to be highest, and the extraction ratio is decreased in the order of the cyan ink, the magenta ink, and the black ink, for example. The extraction ratios are set in this manner in order to address the following problem that may occur when the underlying image is printed: a color of process color ink that is not conspicuous against the color of the underlying color layer (in this example, white) is developed more weakly than the other colors of process color ink, and as a result, the image in a finished state has a color balance different from that of the original image. The process color ink used for the underlying image is ejected at the same time with the special color ink used for the underlying color layer. Therefore, the process color ink is mixed with the special color ink on the recording medium 5. For this reason, a color of process color ink that is not conspicuous against the color of the underlying color layer is developed weakly. In the present preferred embodiment, the yellow ink is developed most weakly, among the four colors of process color ink, against the white ink, and the developing strength is increased in the order of the cyan ink, the magenta ink, and the black ink. Whether the development of a certain color of process color ink is strong or weak in an underlying image is primarily related to the difference in brightness of the certain color of ink from the special color ink. Process color ink of a color having a small brightness difference from the special color ink is developed more weakly in an underlying image than process color ink of a color having a large brightness difference from the special color ink.

The printer 10 in the present preferred embodiment includes the extraction ratio setter 104*a*, by which the extraction ratio may be set for each color of process color ink. The extraction ratio for each color is adjusted, so that the image quality may be adjusted. The printer 10 in the present preferred embodiment prepares a plurality of image quality types including an image quality type for which the extraction ratio for a color of process color ink developed weakly in the underlying image is set to be high (e.g., quality image A). The user may select the image quality type to print an image having a desired color balance. There may preferably be an image quality type, such as the image quality type B shown in FIG. 5, for which the extraction ratios for all of the colors are set to be equal or substantially equal to each other with no adjustment on the hue.

The printer 10 in the present preferred embodiment preferably prepares an image quality type for which a color of process color ink having a smaller brightness difference from the special color ink is set to have a higher extraction ratio. A reason for this is that as described above, a color of process color ink having a small brightness difference from the special color ink is developed more weakly in the underlying image than a color of process color ink having a large brightness difference from the special color ink. Specifically, the extraction ratio for the yellow ink, which is closest, among the four colors of process color ink, in brightness to the white ink, is set to be the highest. The extraction ratio for the cyan ink, which is next closest in brightness to the white ink, is set to be the next highest. The extraction ratio for the magenta ink, which is next closest in brightness to the white ink, is set to be the next highest. The extraction ratio for the black ink, which is least close in brightness to the white ink, is set to be the lowest.

Based on the knowledge of the inventors of preferred embodiments of the present invention, it is preferable that the extraction ratio for each color of ink is set to about 1% to about 50%, for example. In the case in which the special color ink is the white ink, it is preferable that the extraction ratio for the yellow ink is set to be higher than the extraction ratios for the other colors of ink because the yellow ink is developed more weakly than the other colors of ink. In this case, it is preferable that the difference in the extraction ratio between the yellow ink and each of the other colors of ink is set to about 5% to about 30%, for example.

Hereinafter, a printing process performed by the printer 10 in the present preferred embodiment after the extraction ratio for each color of process color ink is determined will be briefly described. In the following, a case in which the "first overlapping printing" and the "image quality type A" are selected as shown in FIG. 4 will be described. In the "first overlapping printing", the underlying color and the underlying image are printed to form the lower layer, whereas the subject image is printed to form the upper layer.

Figure 6:
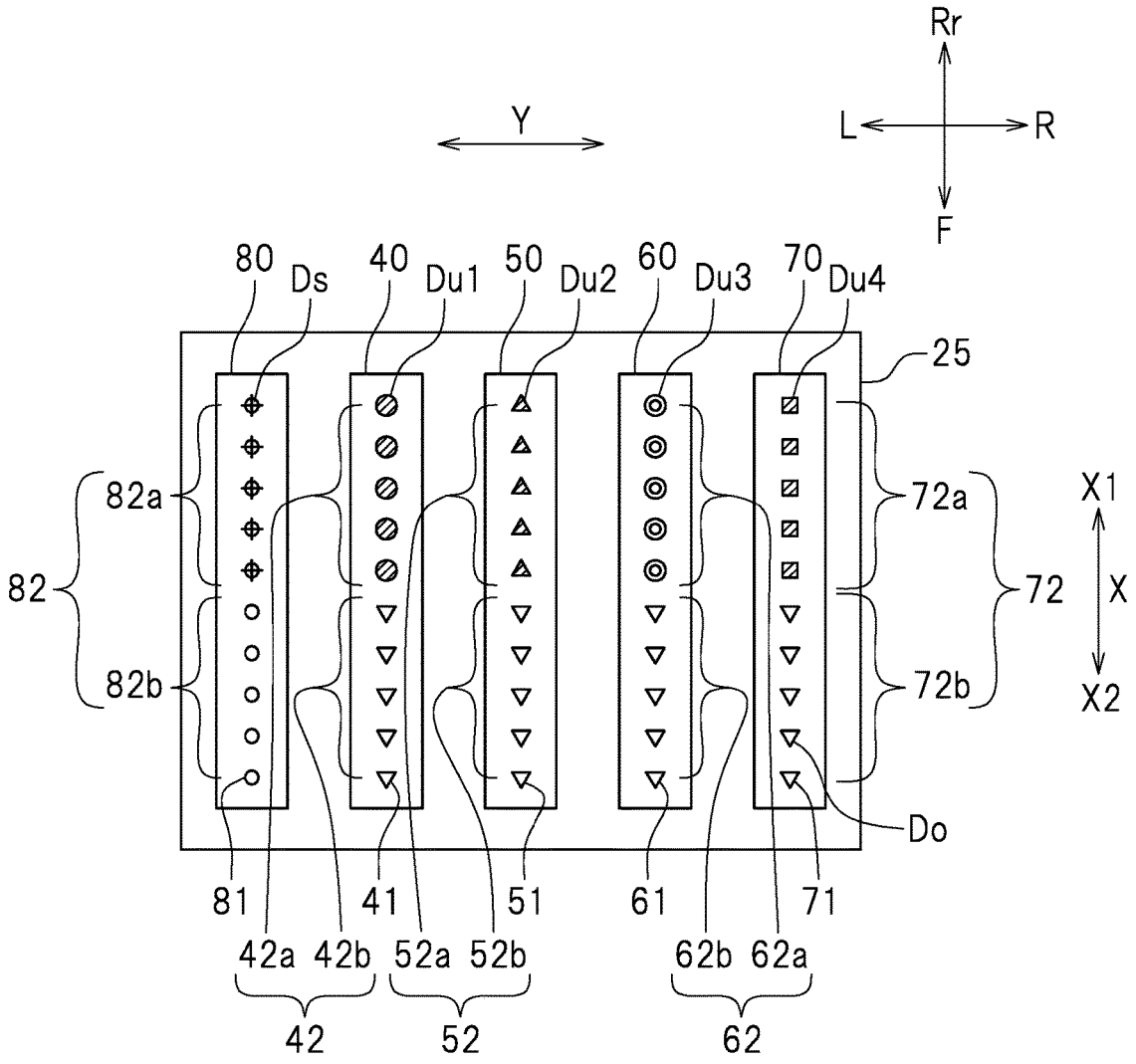
FIG. 6 shows how ink is ejected from each nozzle in "first overlapping printing".

FIG. 6 shows how the ink is ejected from each of the nozzles in the "first overlapping printing". In FIG. 6, the nozzles through which the ink of the first underlying layer dot group (represented by Du1 in FIG. 6) is ejected are represented by hatched circles. The nozzles through which the ink of the second underlying layer dot group (represented by Du2 in FIG. 6) is ejected are represented by triangles. The nozzles through which the ink of the third underlying layer dot group (represented by Du3 in FIG. 6) is ejected are represented by double circles. The nozzles through which the ink of the fourth underlying layer dot group (represented by Du4 in FIG. 6) is ejected are represented by squares. The nozzles through which the ink of the image dot group (represented by Do in FIG. 6) is ejected are represented by inverted triangles. The nozzles through which the special color ink (represented by Ds in FIG. 6) is ejected are represented by crosses.

As shown in FIG. 6, the special color ink Ds is ejected from the nozzles 81 of the special color upstream nozzle array 82*a*, among the nozzles 81 of the special color ink head 80. The ink of the first underlying layer dot group Du1 is ejected from the nozzles 41 of the first process color upstream nozzle array 42*a*, among the nozzles 41 of the first process color ink head 40. This is also applicable to the other process color ink head 50 through 70. The ink of the second underlying layer dot group Du2 is ejected from the nozzles 51 of the second process color upstream nozzle array 52*a*, among the nozzles 51 of the second process color ink head 50. The ink of the third underlying layer dot group Du3 is ejected from the nozzles 61 of the third process color upstream nozzle array 62*a*, among the nozzles 61 of the third process color ink head 60. The ink of the fourth underlying layer dot group Du4 is ejected from the nozzles 71 of the fourth process color upstream nozzle array 72*a*, among the nozzles 71 of the fourth process color ink head 70. That is, the special color ink and the process color ink of each of the "underlying layer dot groups" are ejected from the nozzles of the upstream nozzle arrays. The amount of the black ink ejected as the "first underlying layer dot group" occupies about 5%, for example, of the black ink in the original image. The amount of the yellow ink ejected as the "second underlying layer dot group" occupies about 34%, for example of the yellow ink in the original image. The amount of the magenta ink ejected as the "third underlying layer dot group" occupies about 27%, for example, of the magenta ink in the original image. The amount of the cyan ink ejected as the "fourth underlying layer dot group" occupies about 28%, for example, of the cyan ink in the original image.

The ink of the image dot group Do is ejected from the nozzles 41 of the first process color downstream nozzle array 42*b*, among the nozzles 41 of the first process color ink head 40. Similarly, the ink of the image dot group Do is ejected from the nozzles of the downstream nozzle arrays of the second process color ink head 50 through the fourth process color ink head 70. That is, the process color ink of the "image dot group" is ejected from the nozzles of the downstream nozzle arrays of the process color ink heads 40 through 70. The amount of the process color ink ejected as the "image dot group" occupies about 100%, for example, of the original image.

The upstream nozzle arrays of the ink heads are located on the upstream side X1 in the feeding direction X with respect to the downstream nozzle arrays. The recording medium 5 is fed from the rear side Rr towards the front side F (from the upstream side X1 towards the downstream side X2 in the feeding direction X). Therefore, the upstream nozzle arrays are always used to print before the downstream nozzle arrays. For this reason, the ink ejected from the upstream nozzle arrays forms a printing layer below the ink ejected from the downstream nozzle arrays. In the "first overlapping printing", the printer 10 according to the present preferred embodiment repeats the printing shown in FIG. 6 intermittently. In this manner, the printer 10 according to the present preferred embodiment is able to perform the "first overlapping printing" without feeding the recording medium 5 back towards the upstream side X1 in the feeding direction X.

In the case in which the "second overlapping printing" is selected, the upstream nozzle arrays and the downstream nozzle arrays have opposite roles to those of the "first overlapping printing". More specifically, the process color ink of the image dot group Do is ejected from the nozzles of the upstream nozzle arrays. The special color ink Ds is ejected from the nozzles 81 of the special color downstream nozzle array 82*b*. The process color ink of the underlying layer dot groups Du1 through Du4 is ejected from the nozzles of the downstream nozzle arrays of the process color ink heads 40 through 70. In this manner, the printer 10 according to the present preferred embodiment is able to perform printing both in the "first overlapping printing" and the "second overlapping printing" without feeding the recording medium 5 back towards the upstream side X1 in the feeding direction X.

In the above-described preferred embodiment, the image quality setting screen allows one image quality type to be selected from a plurality of image quality types for which the extraction ratio for each color of process color ink is set in advance (in the example of FIG. 4, the image quality types A through E). Alternatively, the image quality setting screen may be configured such that, for example, the user may set the extraction ratio for each color of process color ink. Still alternatively, the image quality setting screen may be configured such that the user may fine-tune the hue. There is no limitation on the layout of the image quality setting screen.

The above-described preferred embodiments are merely examples, and the technologies disclosed herein may be carried out in any of various forms and configurations.

For example, in the above-described preferred embodiments, the "image dot group" preferably is formed of about 100% of the ink dots of the plurality of colors of process color ink. That is, the subject image is the same as the original image. Alternatively, the subject image may not be the same as the original image. The subject image may be a portion of the original image. It is sufficient that the sum of the ink dots of the underlying image and the ink dots of the subject image include all of the ink dots of the original image. In other words, it is sufficient that the "image dot group" includes at least the ink dots, of the plurality of colors of process color ink, other than the ink dots included in the "underlying layer dot groups". Ink dots may be included in both of the "image dot group" and the "underlying layer dot groups". The extraction ratio of the ink dots of the "image dot group" may not be equal among the plurality of colors of process color ink. The extraction ratio of the ink dots of the "image dot group" may be different among different colors of process color ink.

In the above-described preferred embodiments, the printing preferably is performed by single pass printing. According to the single pass printing, printing of one printing region is finished by one time of scanning. In the overlapping printing, there is such a printing region for each of the "first printing layer" and the "second printing layer". Alternatively, the technology disclosed herein may be performed by multi-pass printing. According to the multi-pass printing, printing of one printing region is finished by a plurality of times of scanning.

According to the "overlapping printing" in the above-described preferred embodiments, two layers, that is, a lower layer and an upper layer, preferably are printed in an overlapping state. Alternatively, three or more layers may be printed in an overlapping state. For example, three layers including an underlying color layer, an image layer, and a top coat may be printed in an overlapping state. In this case, the top coat may preferably be formed of, for example, transparent ink. In the case in which three or more layers are printed in an overlapping state, another dot group may be generated of the ink dots of each color of the process color ink, not only the "underlying layer dot group" and the "image dot group".

In the above-described preferred embodiment, the ink heads 40 through 80 in the carriage 25 are located side by side in the scanning direction Y. Alternatively, the ink heads may be located in a different positional arrangement. For example, the process color ink heads and the special color ink head may be offset in the feeding direction X. In the case in which the process color ink heads and the special color ink head are completely offset in the feeding direction X, the nozzle arrays in each ink head are not divided into the upstream nozzle array and the downstream nozzle array. In this case, all of the nozzles in the ink head are usable. In the case in which the process color ink heads and the special color ink head are partially offset in the feeding direction X, the number of the usable nozzles are preferably smaller than in the case in which the ink heads are completely offset, but the carriage 25 is more compact. Alternatively, the process color ink heads and the special color ink head may be mounted on, and may be movable by, different carriages. Still alternatively, the printing of the "first printing layer" and the printing of the "second printing layer" may be performed in completely different steps.

In the above-described preferred embodiments, the plurality of colors of ink preferably are ejected from different ink heads. The technology disclosed herein is not limited to this. One ink head may include a plurality of nozzle arrays, and a plurality of colors of ink may be ejected from the one ink head. The "recording head" in the technology disclosed herein encompasses such a recording head.

In the above-described preferred embodiments, the ink preferably is ejected by a piezo-driving system of changing the volume of the pressure chamber by the displacement of the piezoelectric element. Alternatively, a printer according to a preferred embodiment of the present invention may use, for example, any of continuous systems including such as a binary deflection system, a continuous deflection system, and other suitable continuous systems, or any of on-demand systems including a thermal system and other suitable on-demand systems. There is no limitation on the ink ejection system of the technology disclosed herein.

In the above-described preferred embodiments, the carriage 25 preferably moves in the scanning direction Y and the recording medium 5 moves in the feeding direction X. Printers according to preferred embodiments of the present invention are not limited to such a system. The movement of the carriage 25 and the recording medium 5 are relative, and either one of the carriage and the recording medium 5 may be moved in the scanning direction Y or the feeding direction X. For example, the recording medium 5 may be unmovable and the carriage 25 may be movable in both of the scanning direction Y and the feeding direction X. Alternatively, both of the carriage 25 and the recording medium 5 may be movable in both of the directions.

The technologies disclosed herein are applicable to any of various types of inkjet printers. The technologies disclosed herein are applicable to a roll-to-roll printer that feeds roll recording medium 5 described in the above-described preferred embodiments, or to a flat-bed inkjet printer, for example. The printer 10 is not limited to a printer that is independently usable, and may be a printer combinable with another device. For example, the printer 10 may be incorporated into another device.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many of various forms and configurations. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiment described herein. The present invention encompasses any of preferred embodiments including equivalent elements, modifications, deletions, combinations, improvements, and/or alterations which may be recognized by a person of ordinary skill in the art based on the disclosure. The elements of each claim should be interpreted broadly based on the terms used in the claim, and should not be limited to any of the preferred embodiments described in this specification or used during the prosecution of the present application.

What is claimed is:

1. An inkjet printer, comprising:

a recording head including:

a first color ink head including a plurality of nozzles through which first ink of a first color is ejected towards a recording medium to form ink dots of the first ink of the first color on the recording medium;

a second color ink head including a plurality of nozzles through which first ink of a second color is ejected towards the recording medium to form ink dots of the first ink of the second color on the recording medium; and a second ink ink head including a plurality of nozzles through which second ink is ejected towards the recording medium to form ink dots of the second ink on the recording medium;

a transporter to move the recording head and the recording medium with respect to each other; and a controller connected with the recording head and the transporter to control the recording head and the transporter; wherein the controller is configured or programmed to include:

a first extractor to extract a first underlying layer dot group from the ink dots of the first ink of the first color such that a ratio of the first underlying layer dot group with respect to the ink dots of the first ink of the first color is a first extraction ratio;

a second extractor to extract a second underlying layer dot group from the ink dots of the first ink of the second color such that a ratio of the second underlying layer dot group with respect to the ink dots of the first ink of the second color is a second extraction ratio;

a first printing controller configured or programmed to form a first printing layer, on the recording medium, of at least the first underlying layer dot group, the second underlying layer dot group and the ink dots of the second ink; and at least one additional printing controller to form at least one additional printing layer, above or below the first printing layer, of an image dot group including at least the ink dots, of the first ink of the first color, other than the first underlying layer dot group and the ink dots, of the first ink of the second color, other than the second underlying layer dot group.

2. The inkjet printer according to claim 1, wherein the first ink of the first color is a first process color ink;

the first ink of the second color is a second process color ink different from the first process color ink; and the second ink is a special color ink.

3. The inkjet printer according to claim 1, wherein the second extraction ratio is different from the first extraction ratio.

4. The inkjet printer according to claim 1, wherein the first ink of the second color has a smaller brightness difference from the second ink than the first ink of the first color; and the second extraction ratio is higher than the first extraction ratio.

5. The inkjet printer according to claim 4, wherein the first ink of the first color is black ink;

the first ink of the second color is yellow ink; and the second ink is white ink.

6. The inkjet printer according to claim 4, wherein the first ink of the first color is cyan ink;

the first ink of the second color is yellow ink; and the second ink is white ink.

7. The inkjet printer according to claim 4, wherein the first ink of the first color is magenta ink;

the first ink of the second color is yellow ink; and the second ink is white ink.

8. The inkjet printer according to claim 1, wherein the first extraction ratio is about 1% or higher and about 50% or lower; and the second extraction ratio is about 1% or higher and about 50% or lower.

9. The inkjet printer according to claim 1, wherein the image dot group includes a portion of, or an entirety of, the first underlying layer dot group and a portion of, or an entirety of, the second underlying layer dot group.

10. The inkjet printer according to claim 1, wherein the controller includes a mode selector that selects any one of a plurality of printing modes including a first printing mode of printing the first printing layer below the at least one additional printing layer and a second printing mode of printing the first printing layer above the at least one additional printing layer.

11. The inkjet printer according to claim 1, wherein a number of the at least one additional printing layer is one.

12. The inkjet printer according to claim 1, wherein the at least one additional printing controller is configured or programmed to include a second printing controller;

the at least one additional printing layer includes a second printing layer;

the transporter includes a feeder feeding the recording medium;

the first color ink head, the second color ink head, and the second ink ink head are disposed side by side in a scanning direction perpendicular or substantially perpendicular to a feeding direction in which the recording medium is fed;

the first color ink head includes:

a first color upstream nozzle array including a portion of the plurality of nozzles arrayed in the feeding direction; and a first color downstream nozzle array including another portion of the plurality of nozzles arrayed in the feeding direction, the first color downstream nozzle array being located downstream with respect to the first color upstream nozzle array in the feeding direction;

the second color ink head includes:

a second color upstream nozzle array including a portion of the plurality of nozzles arrayed in the feeding direction; and a second color downstream nozzle array including another portion of the plurality of nozzles arrayed in the feeding direction, the second color downstream nozzle array being located downstream with respect to the second color upstream nozzle array in the feeding direction;

the second ink ink head includes:

a second ink upstream nozzle array including a portion of the plurality of nozzles arrayed in the feeding direction; and a second ink downstream nozzle array including another portion of the plurality of nozzles arrayed in the feeding direction, the second ink downstream nozzle array being located downstream with respect to the second ink upstream nozzle array in the feeding direction;

the first printing controller:

when the first printing layer is to be printed below the second printing layer, causes the nozzles of the first color upstream nozzle array to eject the first ink of the first color of the first underlying layer dot group, causes the nozzles of the second color upstream nozzle array to eject the first ink of the second color of the second underlying layer dot group, and causes the nozzles of the second ink upstream nozzle array to eject the second ink, to print the first printing layer; and when the first printing layer is to be printed above the second printing layer, causes the nozzles of the first color downstream nozzle array to eject the first ink of the first color of the first underlying layer dot group, causes the nozzles of the second color downstream nozzle array to eject the first ink of the second color of the second underlying layer dot group, and causes the nozzles of the second ink downstream nozzle array to eject the second ink, to print the first printing layer; and the second printing controller:

when the first printing layer is to be printed below the second printing layer, causes the nozzles of the first color downstream nozzle array to eject the first ink of the first color, and causes the nozzles of the second color downstream nozzle array to eject the first ink of the second color, to print the second printing layer; and when the first printing layer is to be printed above the second printing layer, causes the nozzles of the first color upstream nozzle array to eject the first ink of the first color, and causes the nozzles of the second color upstream nozzle array to eject the first ink of the second color, to print the second printing layer.

* * * * *